United States Patent [19]

Kono et al.

[11] Patent Number: 4,745,440

[45] Date of Patent: May 17, 1988

[54] IMAGE FORMING APPARATUS

[75] Inventors: Kimio Kono; Haruo Shimizu, both of Yokohama; Koichi Miyamoto, Tama, all of Japan

[73] Assignee: Canon Kabushiki Kaisha, Tokyo, Japan

[21] Appl. No.: 73,887

[22] Filed: Jul. 16, 1987

Related U.S. Application Data

[63] Continuation of Ser. No. 822,962, Jan. 28, 1986, abandoned, which is a continuation of Ser. No. 465,575, Feb. 10, 1983, abandoned.

[30] Foreign Application Priority Data

Feb. 17, 1982 [JP] Japan ..... 57-25108

[51] Int. Cl.[4] ..... G03G 15/00

[52] U.S. Cl. ..... 355/14 SH; 355/14 D; 355/14 R; 355/14 C

[58] Field of Search ..... 355/14 C, 14 SH, 14 R, 355/14 D, 3 DD, 3 SH; 346/160

[56] References Cited

U.S. PATENT DOCUMENTS

| | | | |
|---|---|---|---|
| 4,315,685 | 2/1982 | Inuzuka et al. | 355/14 DX |
| 4,350,439 | 9/1982 | Tanioka et al. | 355/14 SH |
| 4,386,845 | 6/1983 | Miyoshi et al. | 355/3 DD X |
| 4,432,634 | 2/1984 | Tabuchi | 346/160 X |

*Primary Examiner*—Ulysses Weldon

*Attorney, Agent, or Firm*—Fitzpatrick, Cella, Harper & Scinto

[57] ABSTRACT

An image forming apparatus of an improved construction, which comprises a viewable image forming medium to form a viewable image on a recording sheet; storage members for accommodating a plurality of sheets of the recording material; processing device for forming an image onto the recording sheet fed from the storage member by use of the viewable image forming medium; and control device for enabling the image forming operation to be continued until the storage members are dismounted from the apparatus, even though the viewable image forming medium falls short.

12 Claims, 6 Drawing Sheets

IMAGE FORMING APPARATUS

This application is a continuation of application Ser. No. 822,962, filed Jan. 28, 1986, which was a continuation of application Ser. No. 465,575, filed Feb. 10, 1983, both now abandoned.

BACKGROUND OF THE INVENTION

1. Field of the Invention

This invention relates to an image forming apparatus such as electrophotographic apparatus, ink-jet printers, etc. of a type, which effects image formation on a recording material such as paper, etc. with the use of developer, ink, and the like.

2. Description of the Prior Art

An image forming apparatus such as, for example, an intelligent copier, using a laser beam printer operates in such a way that it receives image information in the form of electrical signals, scans the surface of a photosensitive drum with use of a laser beam flashing in accordance with the electrical signals to thereby form an electrostatic latent image, then a developing agent (toner) stored in a developer container is caused to adhere onto the electrostatic latent image to render it viewable, and the thus developed image is transferred onto a recording member such as plain paper. The toner remaining on the surface of the photosensitive drum without being transferred is scraped off with a cleaner. Since this toner has a lowered developing performance, and, moreover, contains therein paper dust, it cannot be re-used, hence the toner is collected in a collecting vessel as disabled toner (or refuse).

In the above-described construction of the image forming apparatus, the quantity of the toner in the developer vessel decreases as the recording operations are repeatedly conducted, while the quantity of the disabled toner in the collecting vessel increases. When the toner in the developer vessel begin to run out, the transferred image on the recording sheet becomes thin or uneven. On the other hand, the disabled toner can fill up the collecting vessel and stain the interior of the image forming apparatus.

Accordingly, when the toner begins to run out in the developer vessel or toner refuse fills up the collecting vessel, there has generally been taken a step to detect the toner shortage in the developer vessel and/or the fill-up of the toner refuse in the collecting vessel to stop operations of the image forming apparatus, or to display the result of the detection. Specifically, when the toner shortage in the developer vessel and/or the fill-up of the toner refuse in the collecting vessel is detected, any of the following actions has been taken:

(1) The detected result is displayed but the image forming operations are continued;

(2) Image forming operations are stopped after discharge of the printed sheet currently being processed; or (3) Image forming operations are stopped with discharge of the last printed sheet in a continuous printing operation.

With the above action (1), when an operator gives no attention to the display of the detected result and continues the printing operation to the end, the reproduced images become thin and the toner refuse fills up and overflows from the collecting vessel with the result that the warning display is of no use at all.

With the above actions (2) and (3), a down-time occurs in the image forming apparatus in spite of the toner remaining in the developer vessel to an extent that enables the apparatus to continue its normal operations, which requires intervention by an operator.

The above-described various inconveniences take place not only with the toner used in a laser beam printer, but also with toners used in ordinary reproduction apparatuses and ink, and the like used in ink-jet printers.

SUMMARY OF THE INVENTION

The present invention has been made with a view to eliminating those disadvantages inherent in the conventional image forming apparatus, and aims at providing an improved image forming apparatus which is capable of taking effective measures against shortage of the toner or ink, or the like.

Another object of the present invention is to provide an image forming apparatus which performs appropriate operations when the collecting vessel for the disabled toner or ink becomes full.

The foregoing objects, other objects as well as specific construction and operations of the image forming apparatus according to the present invention will become more apparent and understandable from the following detailed description thereof when read in conjunction with the accompanying drawing.

DETAILED DESCRIPTION OF THE PREFERRED EMBODIMENTS

In the following, the present invention will be described in detail in reference to the accompanying drawing.

Figure 1:
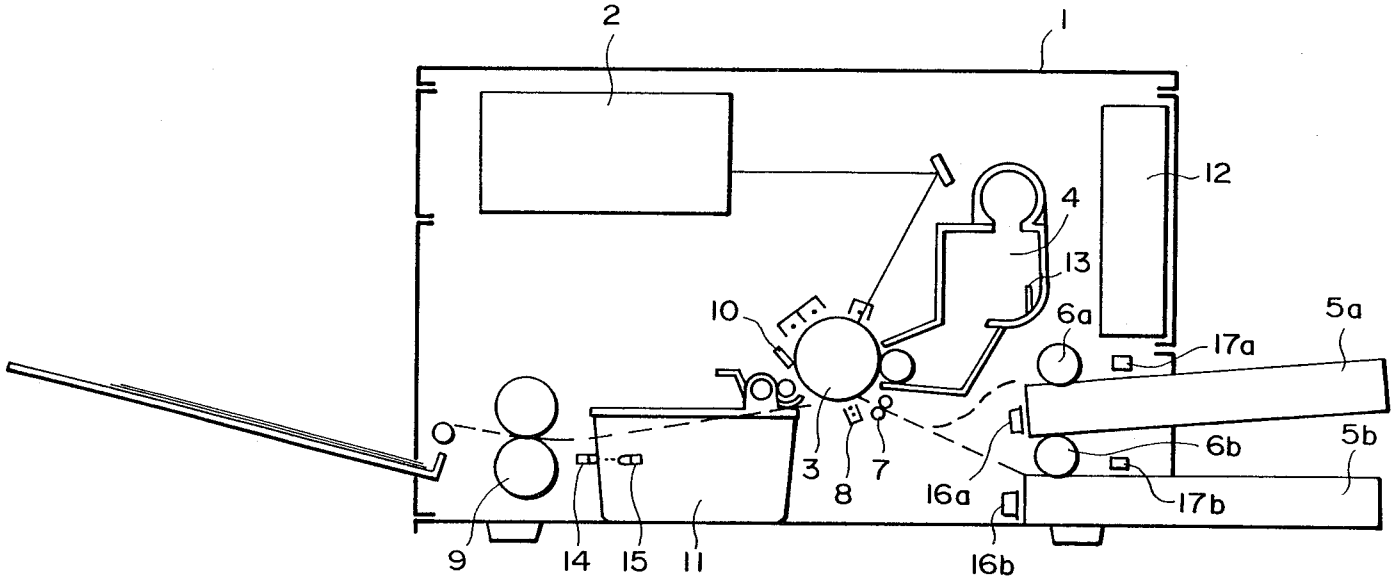
FIG. 1 is a cross sectional view of one embodiment of the image forming apparatus according to the present invention.

Referring first to FIG. 1 which is a cross-sectional view showing one embodiment of the image forming apparatus according to the present invention, when it is applied to a laser beam priner, a reference numeral 1 designates an image forming apparatus, a numeral 2 refers to an optical system to scan a laser source and laser beam to form an image on a photosensitive drum 3, a numeral 4 represents a developer to develop an electrostatic latent image formed on the photosensitive drum 3 by the laser beam scanning, 5*a* and 5*b* denote upper and lower paper feeding cassettes, 6*a* and 6*b* upper and lower paper feeding rollers, 7 a timing roller to carry out position-matching operation between the recording sheet and the image on the photosensitive drum 3, 8 an image transfer charger to transfer the toner image onto the recording sheet, 9 an image fixer to fix the toner as transferred onto the recording sheet, 10 a cleaner to scrape off the toner remaining on the photosensitive drum 3 after the image transfer operation 11 a residual toner collecting vessel to store therein the residual toner which has been scraped off by the cleaner 10 (the residual toner will hereinafter be called "disabled toner" or "toner refuse"), 12 a control circuit for the image forming apparatus, 13 a toner sensor to detect a remaining quantity of the tonger in the developer 4, 14 and 15 are respectively a lamp and a light receiving element to detect presence of the disabled toner in the disabled toner collecting vessel 11, and 16*a* and 16*b* are switches for obtaining a cassette size signal and a cassette empty signal for the upper and lower paper feeding cassettes, respectively.

In the following, the operations of the image forming apparatus of the above-described construction will be described.

In FIG. 1, as soon as the laser beam which is turned on and off in accordance with electrical signals from outside is irradiated on the photosensitive drum 3 by the scanning optical system 2, there is formed an electrostatic latent image on the surface of the photosensitive drum 3 which has been uniformly charged in advance. The latent image is then made viewable by a developer 4. On the other hand, sheets of recording paper stacked in the upper cassette 5*a* are taken out by the upper cassette feeding roller 6*a*, and fed forward to the photosensitive drum 3 with a timing provided by the timing roller 7 for image-matching on the recording sheet.

The toner image on the photosensitive drum 3 is then transferred onto the recording sheet, followed by fixing of the transferred image by the image fixer 9, and a printed copy is obtained. The residual toner which has not taken part in the image transfer operation is scraped off by the cleaner 10, and sent into the disabled toner collecting vessel 11. Through the printing operations, the toner in the developer vessel 4 is consumed, and the disabled toner is accumulated in the toner refuse collecting vessel 11. Presence of the toner in the developer vessel 4 is detected by the toner sensor 13. The toner sensor 13 is able to detect changes in the magnetic permeability of the toner in utilization of the fact that it is made of a magnetic material.

Reference numerals 17*a*, 17*b* designate paper sensors for detecting presence of the recording sheets in the upper and lower paper feeding cassettes 5*a*, 5*b*, respectively. The sensors can utilize reflection and transmission of light, sonic wave, and the like for their sensing operations.

Figure 2:
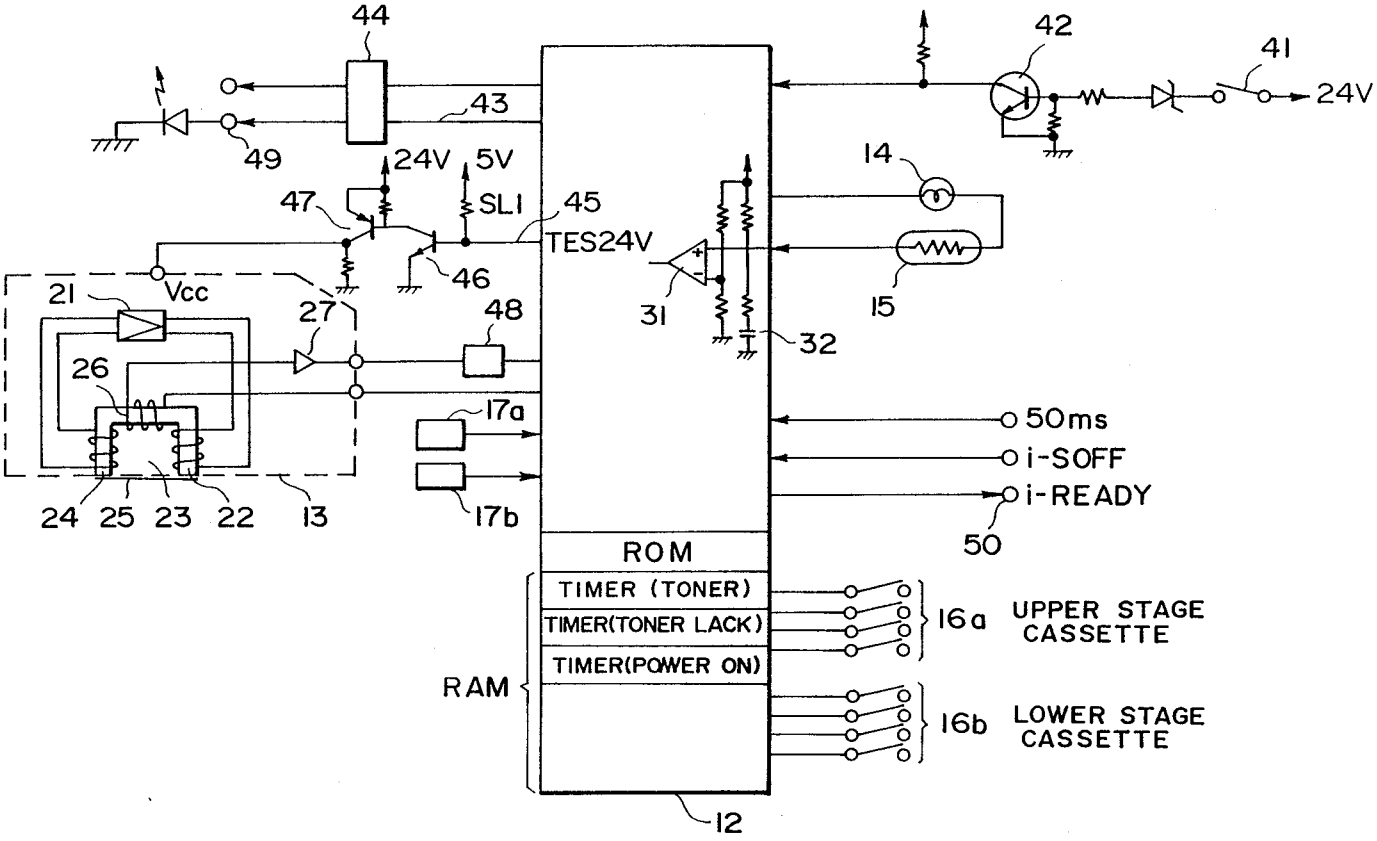
FIG. 2 is a circuit diagram showing one example of a control circuit for the image forming apparatus.

In FIG. 2, the control circuit 12 consists of a one-chip microcomputer. The toner sensor 13 is constructed with an oscillation circuit comprising in combination an amplifier circuit 21 and a positive feed-back circuit made up of a winding 22, a cavity 23, and a winding 24 in loop. In the presence of the toner at the detection section 25, the feedback ratio (a voltage to be induced from the winding 22 to the winding 24) increases due to lowering of the magnetic resistance in the cavity 23, and the circuit oscillates. In the absence of the toner at the detection section 25, however, the feedback ratio decreases due to increase in the magnetic resistance in the cavity 23, and the circuit does not oscillate.

The abovementioned changes in the oscillation are detected by a winding 26, and the detected result is converted to a direct current, after which it is forwarded as an output to the control circuit 12 through a driver 27. When the toner is present at the detected section, the output takes a level "1", and when no toner is present there, the output takes a level "0".

Accordingly, when the toner in the developer 4 becomes lower than a certain level, an output signal "0", indicating a state of toner shortage is produced from the toner sensor 13 to the control circuit 12. The fill-up state of the disabled toner collecting vessel 11 is detected by the lamp 14 and the light receiving element 15. In FIG. 2, CdS is used for the light receiving element 15, which has a property of being high in its resistance in the dark, while low in the bright. The lamp 14 and the light receiving element 15 are disposed in a manner to oppose each other with the disabled toner collecting vessel 11 between them. With this arrangement, variations in the resistance value in the light receiving element 15, which occur depending on whether the toner refuse in the collecting vessel 11 intercepts light from the lamp 14, or not, are compared by a comparator 31 in the control circuit 12 for detection. In view of the fact that CdS exhibits an unstable behavior at the time of the power source rising, such unstable response at this power source rising is substantially removed by means of a capacitor 32 so as not to detect the disabled toner collecting vessel to be in a fill-up condition at the initial stage.

When the shortage of the toner in the developer and the fill-up of the disabled toner collecting vessel have been detected by the abovementioned means, the detected result is displayed by the control circuit 12 on a display board provided in an operating panel (not shown). In this state, however, the printing operation is not prohibited, but it may be made continuable depending on necessity. The reason for this is that, at the instant of detection of the toner shortage or fill-up of the disabled toner collecting vessel, there still remain ample capacity in the developer 4 and the disabled toner collecting vessel 11 to feed the toner therefrom and to receive the disabled toner therein, respctively.

For the abovementioned reason, the printing operation is made continuable, even when the shortage of the toner and the fill-up of the collecting vessel have been detected. Thereafter, the paper sensor 17*a* or 17*b* detects emptying of the sheets in the paper feeding cassette 5*a* or 5*b*. In case, for example, the sheets in the upper cassette 5*a* has become empty, either of the following operations is contemplated: (1) the emptiness of the upper cassette is displayed and the operation of the device is stopped; and (2) the emptiness of the upper cassette is displayed and the operation of the device is continued by automatically changing over the paper feeding operation from the upper paper feeding cassette 5*a* to the lower cassette 5*b*.

In this type of the printing device, most of the users' desires are such that the printing operation can be done in multiple number of sheets on the recording sheet of the same size stacked in a paper feeding cassette rather than it be done on the recording sheet in different sizes stacked in a plurality of paper feeding cassettes for different paper sizes.

According to the preferred embodiment of the present invention, the automatic change-over of the paper feeding from the lower cassette of the upper cassette, or vice versa, is made possible as the operator so desired, provided that the paper size is identical in both upper and lower paper feeding cassettes. While this automatic change-over is chosen, the device does not stop its operation unless the upper and lower paper feeding cassettes become totally empty, whereby the down-time of the device can be reduced.

By the automatic change-over of the paper feeding cassettes, the recording sheets in the lower paper feeding cassette 5*b* are fed by the lower cassette feeding roller 6*b*, and the lower cassette 5*b* soon becomes empty, whereupon the device stops its operation and intervention by the operator becomes first necessary.

In case the toner shortage or the toner refuse vessel fill-up has been detected, and the device stops its operation due to the cassette empty and the operator draws out the paper feeding cassette for its replenishment, the detected signal is taken into the control circuit 12. In this instance, the states of the toner shortage and the toner refuse vessel fill-up give influence on the operations of the printing device, with the consequence that, even if the continuous operations are on the way, the device does not re-start its operation in spite of the paper replenishment, until the toner is replenished or the disabled toner is discarded from the collecting vessel.

Whether the paper cassette is empty or not is detected by the button switches 16*a* and 16*b* for the cassette size detection not being pushed at all.

Thus, so far as the paper is present in the cassette, the device is able to continue its printing operation, even when the toner shortage or the toner refuse vessel fill-up has been detected. Thereafter, when the cassette becomes empty and the operator draws it out of the device for replenishing the sheets further printing operation of the device is prohibited. In this case, too, even if the paper is replenished, the device is prevented its operations from re-starting, unless the toner is replenished or the disabled toner is discarded from the collecting vessel. The same is applicable to a case when the paper feeding cassette become empty on the way of the continuous printing of a plurality of sheets, in which case the device cannot re-start its operation by the paper replenishment alone.

Further, at the time of turning the power source on, the control circuit 12 is so made that it examines the toner shortage and the toner refuse vessel fill-up, and, if at least one of these conditions is found abnormal, it does not cause the device to operate. The reason for this is that, since no cassette empty signal is generated when the paper is replenished in a state of the power source being turned off, the device should be prevented from its operation despite the toner shortage or the toner refuse vessel fill-up state.

The details of the controls in the image forming device of the above-described construction will be explained hereinbelow in reference to FIGS. 2 to 5, note being taken that the flow charts in FIGS. 4 and 5 have been programmed beforehand in ROM of a micro-computer of the control circuit 12. A power source (24 V) for the toner sensor 13 is serially connected with a micro-switch 41 which turns on and off in accordance with opening and closing of a door of the device (vide: FIG. 2).

Figure 4A:
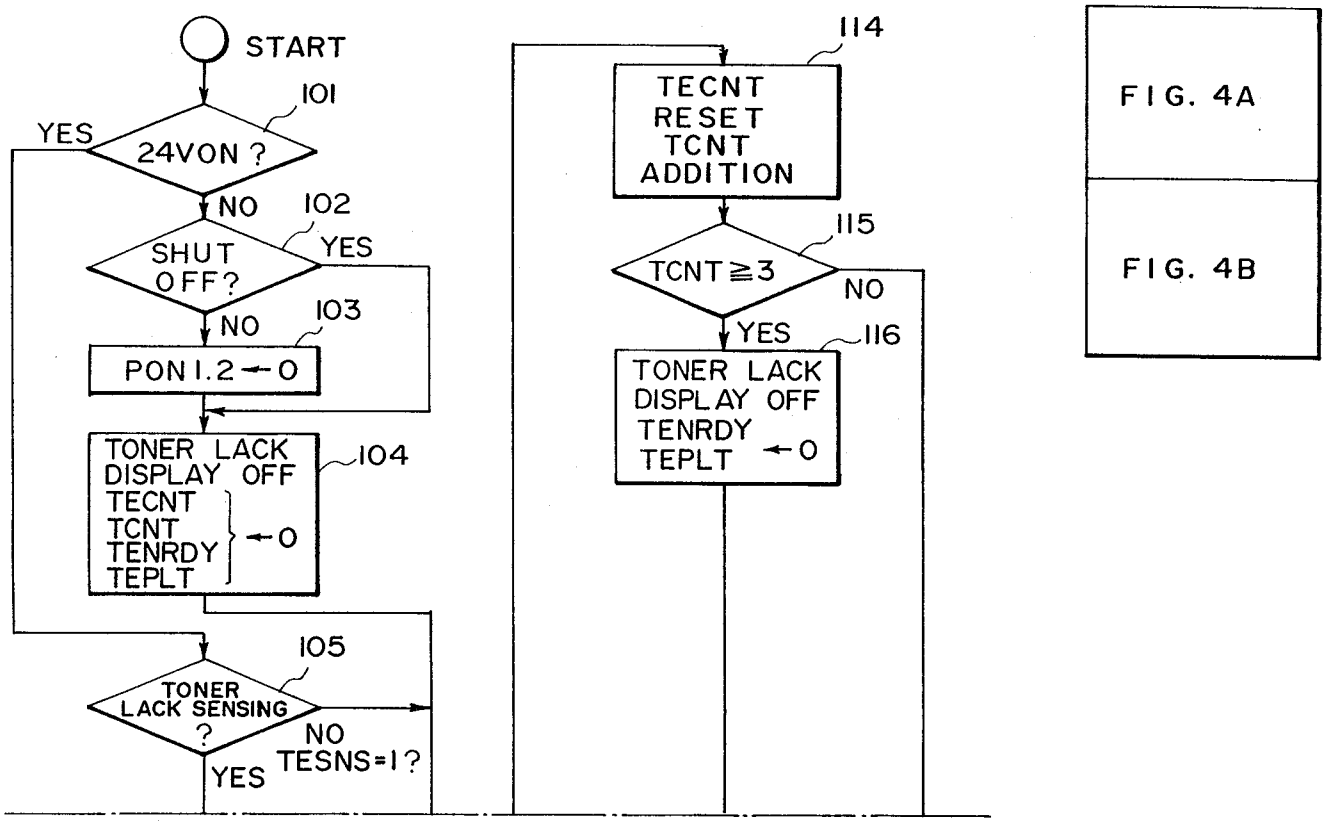
FIGS. 4 and 5 are respectively flow-charts for a toner shortage (or empty) detection section of a developer in the image forming apparatus.
Figure 4B:
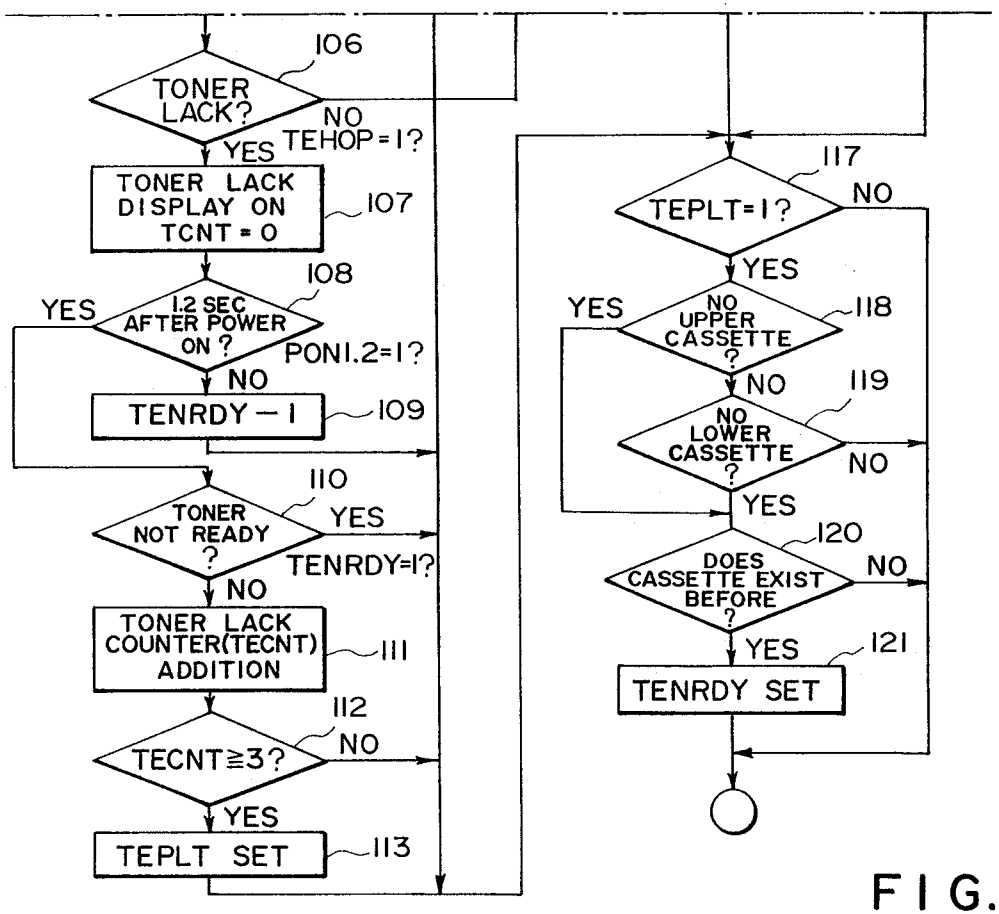
Figure 5:
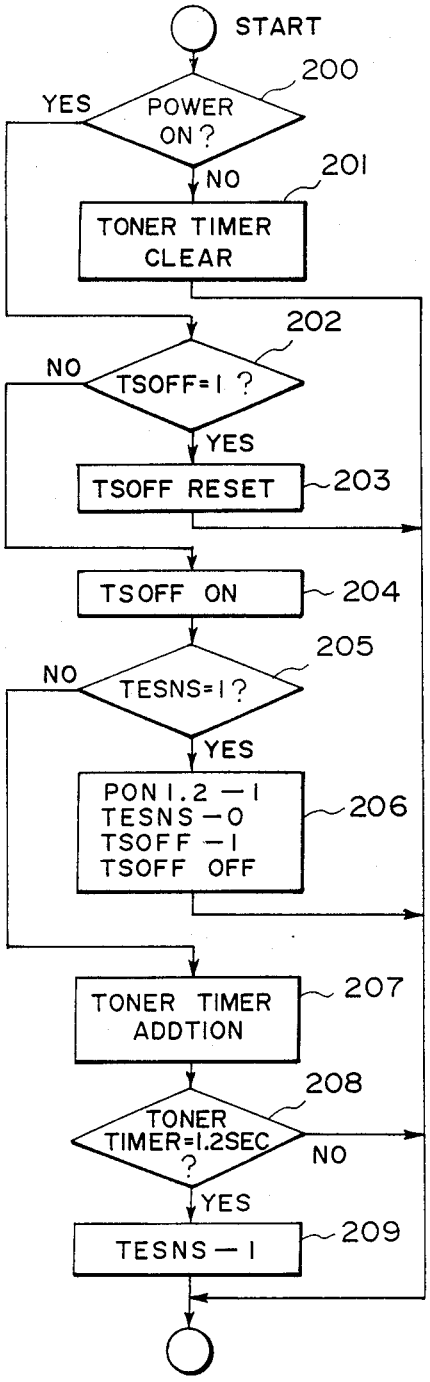

FIG. 4 shows a programme of the toner shortage detection, which is done at any time during the controls of the device.

At Step 101, judgement is made as to whether the power source (24 V) for driving the toner sensor has been applied or not, while watching an output from a transistor 42. If no voltage is applied, examination is made at Step 102 as to whether it is caused by a shut-off instruction (an instruction to open all the power sources other than for the CPU) due to occurrence of abnormality such as paper jamming, etc. in the device. If not, PON 1.2 (a signal to indicate lapse of 1.2 seconds from the power-on in the device) is reset (Step 103). Then, at Step 104, a toner shortage display signal 43 is reset, and the toner shortage display is extinguished through a driver 44. At the same time, various displays such as counters, flag TECNT (toner empty counter), TCNT (toner present counter), TENRDY (toner empty not ready), and TEPLT (toner empty latch) are reset, thereby terminating the process of a non-application state of 24 V.

Figure 3:
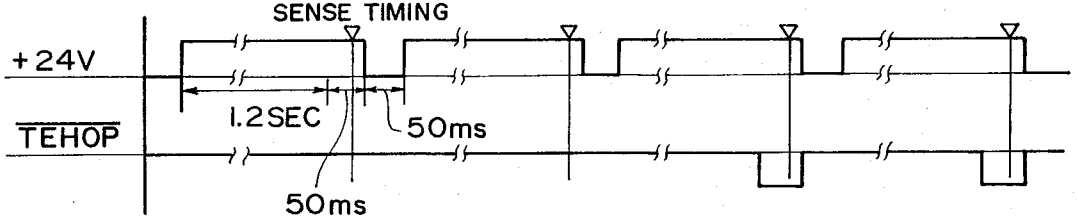
FIG. 3 is a time chart for driving a toner sensor.

The application of 24 V is effected in accordance with the following procedures. It should be noted, in this connection, that, since the toner sensor 13 has no constant time until it returns to an ordinary condition, once an oscillation is latched, it is so constructed that it may return to its initial state for the subsequent detection by opening the power source for the toner sensor after the detection operation. The closing and opening of the power source for the toner sensor 13 is done by a signal SL1 from the control circuit 12. When the signal SL1 "H" is sent into the base of a transistor 46, the transistor is turned on with the consequence that a transistor 47 is also turned on, whereby the power is supplied to the toner sensor 13. On the other hand, when the signal SL1 "L" is forwarded to the base of the transistor 46, the power source is turned off. Incidentally, after the turning-on of the power source, accurate detection can be done only after sufficient power rise in the toner sensor 13. Therefore, in the embodiment according to the present invention as shown in FIG. 3, the sensing operation is repeated for 50 m-sec. after lapse of 1.2 seconds from rising of the power source, and the power source is turned off during the next 50 m-sec. interval. These operations are repeated (a flow chart for this will be explained later).

When the application of the power source voltage 24 V is ascertained at Step 102, the process proceeds to Step 105. At Step 105, TESNS flag indicating the toner shortage under detection is examined. If not under detection, the process proceeds to Step 117. If under detection, a signal from the toner sensor 13 is introduced as an input into the control circuit 12 through a buffer 48 for checking the toner shortage. If it is found that the toner is empty, the toner shortage display is output to a terminal 49 through the driver 44, and an LED is flashed for the purpose of warning. On the other hand, the toner presence counter (TCNT) in RAM is reset.

At the subsequent Step 108, judgement is done as to whether a time period of 1.2 seconds has lapsed after turning-on of the power source for the device. The PON 1.2 flag to be used at this Step 108 will be described later. If the time period of 1.2 seconds has not lapsed after turning-on of the power, it is judged that the operator who effected the power-on operation is with the device, and the TENRDY flag (toner empty not ready) is set.

If 1.2 seconds has lapsed after the power source is turned on, checking is done by the control circuit as to whether the TENRDY flag has already been set, or not, i.e., whether an i-READY signal 50 has already been in a state of "not ready", or not. If the result of checking is positive (Yes), the proces proceeds to Step 117. In the case of negative (No), the process proceeds to Step 111 where the toner empty counter TECNT is counted up. When TECNT flag becomes more than 3 at Step 112, TEPLT flag (toner empty latching flag) is set at Step 113. Here, the reason for repeating the counting operation more than three times is to fix the not-ready signal so that it may not fluctuate under influence of noises, etc. On the other hand, at Step 106, when the toner sensor verifies presence of the toner, the toner empty counter TECNT is reset at Step 114, followed by counting-up of the toner presence counter TCNT. As the result of this, when TCNT has been counted up more than three times, the toner empty display is extinguished by the control circuit 12 through the driver 44, and the TENRDY flag (toner empty not ready flag) and the TEPLT flag (toner empty latching flag) are reset. After this, observation is done at Step 117 as to whether a time period of a few milli-seconds has been continued or not since the TEPLT flag has been set, i.e., the toner empty state has been brought in. If the TEPLT flag has been set, checking is done at Steps 118 and 119 as to whether the upper and lower cassettes are present or not. Absence of the cassette is determined when an actuator provided in each of the cassettes does not push any of the button switches **16*a* and 16*b* to detect the cassette size. In case either of the upper and lower cassettes is not present, which was present in its previous state, it is judged that the cassette was withdrawn, and the TENRDY flag is set at Step 121. All the previous state are stored in the RAM in sequence, which are read out for judgement at Step 120**.

The foregoing is the sequence concerning the toner empty (or shortage). Thereafter, when the toner empty not ready flag TENRDY has been set, the process proceeds to a non-operative sequence of the device to thereby prohibit further printing operation. If it is in the reset condition, the process proceeds to the ordinary sequence.

In this way, when the toner in the developer vessel falls short, if it is a lapse of 1.2 seconds after closure of the power source for the device, the toner empty not ready flag TENRDY to cause the process to proceed to the non-operative sequence of the device is not set instantaneously, even if the toner empty condition is detected, but it is first set when the withdrawal of the cassette has been detected, thereby making it possible to continue the printing operation so far as the recording paper is present in the cassette.

As mentioned in the foregoing, a timing for detecting the toner empty condition is subjected to restriction owing to the rising property, the oscillating property, etc. of the toner sensor 13. In the following, explanations will be given in reference to the flow chart in FIG. 5 as to a time processing routine for obtaining the detection timing.

Prior to the explanation thereof, it should be understood that this routine is an intervening routine which operates by intervention of a timer for 50 m-sec. When the timer intervenes, checking is done at Step 200 as to whether the power source voltage of 24 V is applied or not.

If the power-off is judged at Step 200, a toner timer to be described hereinafter is cleared at Step 201. In case of the power-on, checking is done at Step 202 as to whether a TSOFF flag has been in a set condition or not, i.e., whether the routine should be such that the power source for the toner sensor 13 should be turned off or not. In case of "Yes", the TSOFF flag is rendered "0", and the power source for the toner sensor 13 is turned off at Step 203 through the signal line SL1 from the control circuit 12. In so doing, the process enters the routine for turning on the power source for the toner sensor at the time of the subsequent timer intervention after lapse of 50 m-sec. That is to say, if the TSOFF flag is not in the set condition, the power source for the toner sensor 13 is turned on through the signal line SL1, and then TESNS flag is checked at Step 205 to determine whether the timing is for sensing the toner empty or not. If the TESNS flag is not in the set condition, the toner timer is counted up at Step 207. After lapse of 1.2 seconds, the toner counter is cleared at Step 208, and, at the same time, the TESNS flag is set so as to permit sensing of the toner empty during the subsequent 50 m-sec. period. On the other hand, if the TESNS flag is in the set condition, it is understood that the detection of the toner empty condition has been terminated during the 50 m-sec. period. On this assumption, the TESNS flag is reset, the TSOFF flag is set, and the power source for the toner sensor 13 is turned off so that the toner empty condition may not be sensed in the next routine. In addition, the PON 1.2 flag, which has been reset at the time of closure of the power source for the device, is set, whereby the lapse of 1.2 seconds from closure of the power source for the device is indicated. This PON 1.2 flag is maintained in its set condition unless the power source is again turned off.

Upon completion of the routine processings from Steps 100 to 121 and from Steps 200 to 209, the toner empty condition in the developer vessel can be detected.

A sequence for the disabled toner is substantially same as that for the toner empty. That is, in the above explanation, it is sufficient that the "toner empty" is substituted for the "disabled toner vessel fill-up". It should however be noted that, in the present embodiment, the resistance value of CdS which is used for the sensor is not latched, but it changes continuously in accordance with an incident light, so that there is no necessity for the power source for the sensor being turned on and off as is the case with that for the toner sensor. As the consequence of this, the Steps 200 to 209 are unnecessary. Moreover, Step 105 is not necessary. If the result of detection is "Yes" at Step 101, the process proceeds direct to Step 106 to carry out detection of the disabled toner. The other steps are same as those for the toner empty sequence.

Since the image forming device according to the present invention is of such construction as mentioned in the foregoing, it possesses various favorable features to be mentioned below.

(1) Mere detection of the empty developer vessel and fill-up of the disabled toner collecting vessel does not interrupt the device operations, and the printing operations are made continuable so far as recording paper is in the paper feeding cassette. Consequently, the down time of the device is reduced, and an operator can spend less time on machine maintenance.

(2) Since the action against the toner shortage in the developer vessel and the fill-up of the disabled toner collecting vessel are done at the time of exchanging the paper feeding cassette for replenishment of paper, the printing operations can be prohibited without failure.

It is also feasible that the actions against the toner shortage in the developer vessel and the fill-up of the disabled toner collecting vessel be done at the time of detecting an absence of paper in the cassette, instead of doing the same at the time of drawing the cassette out of the device. In this instance, the device accommodating therein a plurality of paper feeding cassettes and capable of performing the automatic change-over among these cassettes, in particular, is able to take the actions against the toner shortage or the fill-up of the disabled toner collecting vessel every time one paper feeding cassette is empty.

Incidentally, when the toner shortage or the fill-up of the disabled toner collecting vessel occurs, subsequent reproduction operations are prohibited, even when the paper feeding cassette is drawn out of the device with some sheets of paper still remaining in the cassette.

As stated in the foregoing the described embodiment of the present invention uses a two-stage paper feeding cassettes, but the invention is not limited to this number of paper cassette, and any type of paper feeding expedients such as, for example, a single paper feeding cassette, three or more paper feeding cassettes, or a combination of the paper feeding cassettes and a deck, and the like may equally be applied for realizing the purpose of the present invention. In case of using a deck as the paper feeding means, a state where the deck table has been drawn out for the paper replenishment corresponds to the empty state of the cassette.

Besides a laser beam printer, the present invention is also applicable to an LED printer, a stylus printer, and various other reproduction apparatus. Further, the present invention can be applied to detection of shortage in ink for an ink-jet printer and the like. Furthermore, the invention may be applied to a reproduction device in which rolled paper is used as the recording material.

What is claimed is:

1. Image forming apparatus, comprising:

first detection means for detecting quantity of an image forming medium usable to form a visible image on a recording material;

second detection means for detecting whether a storage member for accommodating therein a plurality of sheets of recording material is mounted on the apparatus, said storage member being removably mountable to the apparatus;

process means for performing an image forming operation on recording material fed by feeding means from said storage member to said processing means, said processing means being adapted to form images on the recording material by using said image forming medium; and control means for controlling the image forming operation by said processing means, wherein after a predetermined time elapses from a time when power is applied to the apparatus, said control means is operable to prohibit the image forming operation when said first detection means detects a shortage of said image forming medium and said second detecting means detects that said storage member is removed from the apparatus, and wherein before the predetermined time elapses from a time when power is applied to the apparatus, said control means is operable to prohibit the image forming operation when said first detection means detects a shortage of said image forming medium without regard to the detection output of said second detecting means.

2. Image forming apparatus as set forth in claim 1, further comprising means for displaying that said first detection means detects the shortage of said image forming medium.

3. Image forming apparatus as set forth in claim 1, wherein when the image forming operation is prohibited after the predetermined time from when power is applied to the apparatus, said control means continues to prohibit the image forming operation unless said first detecting means detects that said image forming medium is replenished, and said second detecting means detects that the storage member is again mounted to the apparatus.

4. Image forming apparatus as set forth in claim 1, wherein said processing means performed the image forming operation based on an electrical signal representing an image.

5. Image forming apparatus as set forth in claim 1, wherein said processing means includes a photosensitive member, means for forming a latent image on said photosensitive member, means for developing the latent image using the image forming medium, and means for transferring the developed image to the recording material.

6. Image forming apparatus as set forth in claim 5, wherein said forming means forms the latent image by means of irradiating said photosensitive member with a laser beam.

7. Image forming apparatus as set forth in claim 1, wherein said image forming medium has been stored in a second storage member.

8. Image forming apparatus, comprising:

a first storage member for storing therein an image forming medium usable to form a visible image on a recording material;

a second storage member for accommodating therein a plurality of sheets of recording material, said second storage member being removably mounted on the apparatus;

first detection means for detecting whether said second storage member is mounted on the apparatus;

processing means for performing an image forming operation on recording material fed by feeding means from said second storage member to said processing means, said processing means being adapted to form images on the recording material by using said image forming medium provided from said first storage member;

a third storage member for accommodating therein said image forming medium provided from said first storage member but not used for forming images;

second detection means for detecting the quantity of said image forming medium in said third storage member; and control means for prohibiting the image forming operation by said processing means, wherein after a predetermined time elapses from a time when power is applied to the apparatus, said control means is operable to prohibit the image forming operation when said second detection means detects that the quantity of said image forming medium in said third storage member is above a predetermined level and said first detection means detects that said second storage member is removed from the apparatus, and wherein before the predetermined time elapses from a time when power is applied to the apparatus, said control means is operable to prohibit the image forming operation when said second detection means detects that the quantity of said image forming medium in said third storage member is above a predetermined level, without regard to the detection output of said first detecting means.

9. Image forming apparatus as set forth in claim 8, wherein when the image forming operation is prohibited after the predetermined time from when power is applied to the apparatus, said control means continues to prohibit the image forming operation unless said second detecting means detects that said image forming medium is removed from said third storage member, and said first detection means detects that said second storage member is again mounted to the apparatus.

10. Image forming apparatus as set forth in claim 8, wherein said processing means performs the image forming operation based on an electrical signal representing an image.

11. Image forming apparatus as set forth in claim 8, wherein said processing means includes a photosensitive member, means for forming a latent image on said photosensitive member, means for developing the latent image using the image forming medium, and means for transferring the developed image to the recording material.

12. Image forming apparatus as set forth in claim 11, wherein said forming means forms the latent image by means of irradiating said photosensitive member with a laser beam.

* * * * *

UNITED STATES PATENT AND TRADEMARK OFFICE

CERTIFICATE OF CORRECTION

PATENT NO. : 4,745,440

DATED : May 17, 1988

INVENTOR(S) : KIMIO KONO, ET AL.

It is certified that error appears in the above-identified patent and that said Letters Patent is hereby corrected as shown below:

Column 3, line 3, "tonger" should read --toner--.

Column 4, line 31, "respctively" should read --respectively--;

line 55, "of" should read --to--;

line 56, "desired" should read --desires--.

Column 6, line 56, "proces" should read --process--.

Column 8, line 49, "action" should read --actions--.

Column 9, line 5, "cassettes" should read --cassette--;

line 6, "cassettes" should read --cassette--.

Signed and Sealed this

Thirtieth Day of August, 1988

*Attest:*

DONALD J. QUIGG

*Attesting Officer*

*Commissioner of Patents and Trademarks*